US007383897B2

(12) United States Patent
Moody et al.

(10) Patent No.: US 7,383,897 B2
(45) Date of Patent: Jun. 10, 2008

(54) DOWNHOLE STEERING TOOL HAVING A NON-ROTATING BENDABLE SECTION

(75) Inventors: Michael J. Moody, Katy, TX (US); Haoshi Song, Sugar Land, TX (US); Jay Milton Eppink, Spring, TX (US); William C. Paluch, Jersey Village, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 203 days.

(21) Appl. No.: 11/155,165

(22) Filed: Jun. 17, 2005

(65) Prior Publication Data

US 2006/0283635 A1 Dec. 21, 2006

(51) Int. Cl.
*E21B 7/08* (2006.01)

(52) U.S. Cl. ..... 175/73; 175/61; 175/76

(58) Field of Classification Search ..... 175/73, 175/76, 61

See application file for complete search history.

(56) References Cited

U.S. PATENT DOCUMENTS 2,373,880 A 4/1945 Driscoll
2,603,163 A 7/1952 Nixon
2,874,783 A 2/1959 Haines
2,880,805 A 4/1959 Nelson et al.
2,915,011 A 12/1959 Hamill
3,062,303 A * 11/1962 Schultz ..... 175/61
4,407,374 A 10/1983 Wallussek et al.
4,416,339 A 11/1983 Baker et al.
4,463,814 A 8/1984 Horstmeyer et al.
4,526,241 A * 7/1985 Anders ..... 175/76
4,844,178 A 7/1989 Cendre et al.
4,947,944 A 8/1990 Coltman et al.
4,957,173 A 9/1990 Kinnan
5,070,950 A 12/1991 Cendre et al.
5,538,091 A 7/1996 Theocharopoulos
5,603,386 A 2/1997 Webster
5,747,750 A * 5/1998 Bailey et al. ..... 181/112
5,797,453 A 8/1998 Hisaw
5,857,531 A 1/1999 Estep et al.

(Continued)

FOREIGN PATENT DOCUMENTS

EP 0646693 A2 4/1995

(Continued)

OTHER PUBLICATIONS

Downton, G.C. Carrington, D., "Rotary Steerable Drilling System for the 6-in Hole," presented at the SPE/IADC Drilling Conference held in Amsterdam, The Netherlands, Feb. 19-21, 2003, SPE/IADC 79922.

(Continued)

*Primary Examiner*—Giovanna C Wright

(57) ABSTRACT

A downhole steering tool is disclosed. The steering tool includes a rotatable shaft, a substantially non-rotating tool body deployed about the shaft, and a plurality of force application members deployed on the steering tool body. The steering tool further includes a bendable section deployed in the steering tool body. The bendable section is disposed to bend preferentially relative to the steering tool body under an applied bending load. The use of a steering tool body having a bendable section tends to advantageously reduce bending stresses in the steering tool body during use. Moreover, tools embodying this invention may be suitable for higher dogleg severity applications.

36 Claims, 5 Drawing Sheets

U.S. PATENT DOCUMENTS

| | | | | |
|---|---|---|---|---|
| 5,941,323 | A | 8/1999 | Warren | |
| 6,148,933 | A | 11/2000 | Hay et al. | |
| 6,158,529 | A | 12/2000 | Dorel | |
| 6,213,226 | B1 | 4/2001 | Eppink et al. | |
| 6,227,312 | B1 | 5/2001 | Eppink et al. | |
| 6,290,003 | B1 | 9/2001 | Russell | |
| 6,427,783 | B2 | 8/2002 | Krueger et al. | |
| 6,598,687 | B2 | 7/2003 | Eppink et al. | |
| 6,607,044 | B1 | 8/2003 | Eppink et al. | |
| 6,761,232 | B2 | 7/2004 | Moody et al. | |
| 6,837,315 | B2 | 1/2005 | Pisoni et al. | |
| 6,840,336 | B2 | 1/2005 | Schaaf et al. | |
| 6,843,332 | B2 | 1/2005 | Eppink et al. | |
| 6,845,822 | B2 * | 1/2005 | Chau | 166/380 |
| 2004/0256162 | A1 | 12/2004 | Helms et al. | |
| 2005/0109542 | A1 * | 5/2005 | Downton | 175/73 |

FOREIGN PATENT DOCUMENTS

| | | | |
|---|---|---|---|
| EP | 1174582 | A3 | 1/2002 |
| EP | 1264960 | A2 | 12/2002 |
| GB | 2258877 | A | 2/1993 |
| WO | WO-01/09478 | A1 | 2/2001 |
| WO | WO-01-51761 | A1 | 7/2001 |
| WO | WO-03-097989 | A1 | 11/2003 |

OTHER PUBLICATIONS

Moody, M., Jones, S., and Leonard, P. "Development & Field-Testing of a Cost Effective Rotary Steerable System," presented at the SPE Annual Technical Conference and Exhibition held in Houston, Texas, Sep. 26-29, 2004, SPE 90482.

* cited by examiner

DOWNHOLE STEERING TOOL HAVING A NON-ROTATING BENDABLE SECTION

FIELD OF THE INVENTION

The present invention relates generally to downhole steering tools, such as a three dimensional rotary steerable tool. More specifically, this invention relates to a downhole steering tool including at least one force application member deployed on a substantially non-rotating tool body, the tool body having a section that bends preferentially relative to other sections thereof.

BACKGROUND OF THE INVENTION

Directional control has become increasingly important in the drilling of subterranean oil and gas wells, for example, to more fully exploit hydrocarbon reservoirs. Two-dimensional and three-dimensional rotary steerable tools are used in many drilling applications to control the direction of drilling. Such steering tools commonly include a plurality of force application members (also referred to herein as blades) that may be independently extended out from and retracted into a substantially non-rotating steering tool body. The blades are disposed to extend outward from the steering tool body into contact with the borehole wall and to thereby displace the steering tool body from the centerline of well bore during drilling. The non-rotating steering tool body is typically deployed about a rotating shaft, which is disposed to transfer weight and torque from the surface (or from a mud motor) through the steering tool to the drill bit assembly.

In order to point (or push) the drill bit in a certain direction, one or more of the blades are moved radially outward into contact with the borehole wall to offset the non-rotating tool body from the centerline of the borehole. In a "point the bit" arrangement, the blades offset the steering tool body in substantially the opposite direction as the direction of subsequent drilling, while in a "push the bit" arrangement, the blades offset the steering tool body in substantially the same direction as the direction of subsequent drilling. Increasing the offset tends to correspondingly increase the degree of curvature (bend) in the borehole as it is being drilled.

While such steering tools are conventional in the art and are known to be serviceable for many directional drilling applications, there is yet room for further improvement. For example, there is a trend in the drilling industry towards drilling smaller diameter boreholes having sections with increased dogleg severity (curvature). As such there is a need for rotary steerable tools capable of achieving higher dogleg Severity (e.g., on the order of 10 or more degrees per 100 feet of borehole).

In conventional rotary steerable tools, as the required dogleg severity (curvature) of a borehole increases (particularly in small diameter boreholes) the trailing end (the upper end) of the non-rotating steering tool body tends to contact the borehole wall and thereby limit the ability of the steering tool to achieve a higher dogleg well path. Moreover, increased dogleg severity increases bending stresses in the steering tool body, Which must be accommodated to prevent tool failure.

Therefore, there exists a need for improved downhole steering tools. In particular, there exists a need for small diameter steering tools capable of achieving high dogleg severity. There also exists a need for a mechanism to accommodate the high bending stresses encountered in high dogleg boreholes.

SUMMARY OF THE INVENTION

The present invention addresses one or more of the above-described drawbacks of prior art steering tools. Aspects of this invention include a downhole steering tool having at least one extendable and retractable force application member (e.g., a blade or a pad) disposed to displace the tool from the central axis of the borehole (i.e., to eccenter the tool in the borehole). The force application member is deployed in a substantially non-rotating steering tool body, which is deployed about a rotatable shaft. The steering tool body includes a bendable section, which is disposed to bend preferentially relative to other sections of the steering tool body under an applied bending load. In one exemplary embodiment, the bendable section includes a flex joint having a member that is flexible relative to other sections of the steering tool body. In another exemplary embodiment, the bendable section includes a knuckle joint about which upper and lower portions of the steering tool body may pivot. In certain advantageous embodiments, the bendable section is configured to bend only up to a predefined bending limit and is constrained from bending beyond the predefined bending limit.

Exemplary embodiments of the present invention advantageously provide several technical advantages. For example, the use of a steering tool body having a bendable section tends to reduce bending stresses in the steering tool body during use. In particular, bending stresses may be reduced at otherwise vulnerable points in the steering tool body, such as in the vicinity of one or more control modules. As such, the use of steering tool body having a bendable section tends to improve the structural integrity, and therefore the reliability, of the tool. Moreover, exemplary embodiments of this invention may also advantageously enable boreholes having higher dogleg severity to be drilled, as compared to certain prior art steering tools. Exemplary embodiments of this invention may be particularly advantageous in small diameter steering tools (e.g., steering tools having a diameter less than about 12 inches).

In one exemplary aspect the present invention includes a downhole steering tool. The steering tool includes a rotatable shaft, a substantially non-rotating tool body deployed about the shaft, and a plurality of force application members deployed on the steering tool body. The force application members are disposed to extend radially outward from the steering tool body and engage a borehole wall, with the engagement of the force application members with the borehole wall being operative to eccenter the steering tool body in the borehole. The steering tool further includes a bendable section deployed in the steering tool body. The bendable section is disposed to bend preferentially relative to the steering tool body under an applied bending load. In one exemplary variation of this aspect, the steering tool further includes a mechanical stop disposed to constrain the bendable section from bending beyond a predefined bending limit.

In another exemplary variation of the above described aspect, the bendable section may include a tubular member that is flexible relative to the steering tool body. The steering tool may further optionally include first and second sleeves deployed about the flexible tubular member. The sleeves are disposed to permit flexing of the flexible tubular member up to a predefined bending limit and are further disposed to substantially prevent flexing of the flexible tubular member beyond the predefined bending limit.

In still another exemplary variation of the above described aspect, the bendable section may include a knuckle joint, upper and lower portions of the steering tool body disposed to pivot about the knuckle joint under an applied bending load. The knuckle joint may include a tubular ball member deployed in at least one outer member, the tubular ball member including first and second spherical surfaces pivotably engaged with corresponding first and second spherical surfaces on the at least one outer member. Moreover, the tubular ball member and outer member may optionally be disposed to pivot relative to one another up to a predefined angular limit and constrained from pivoting relative to one another beyond the predefined angular limit.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
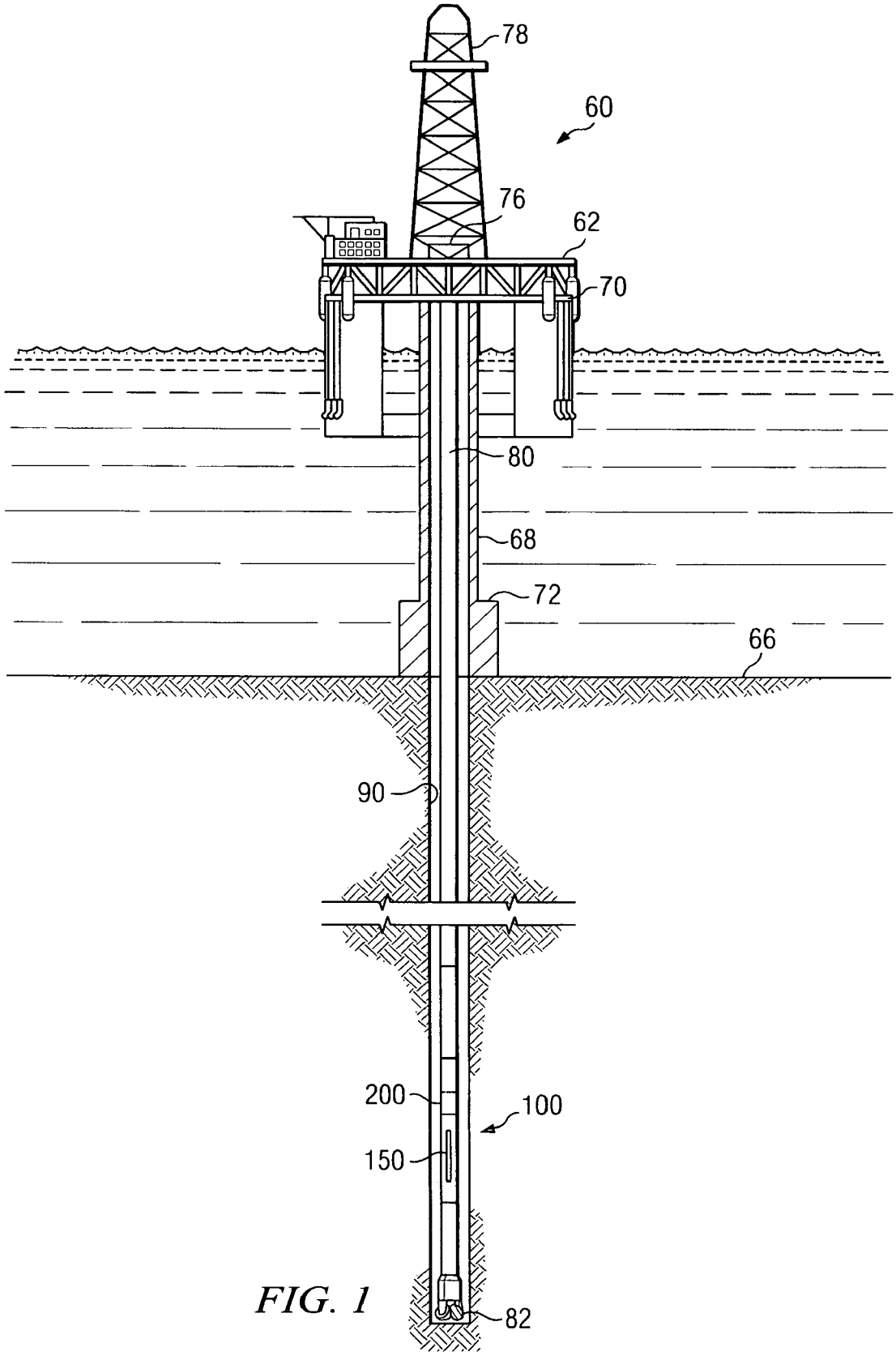
FIG. 1 depicts an offshore oil and/or gas drilling platform utilizing an exemplary steering tool embodiment of the present invention.

Referring to FIGS. 1 through 6, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 6 may be described herein with respect to that reference numeral shown on other views.

FIG. 1 schematically illustrates one exemplary embodiment of a downhole steering tool 100 according to this invention in use in an offshore oil and/or gas drilling assembly, generally denoted 60. Semisubmersible drilling platform 62 is positioned over an oil or gas formation (not shown) disposed below the sea floor 66. A subsea conduit 68 extends from deck 70 of platform 62 to a wellhead installation 72. The platform may include a derrick 76 and a hoisting apparatus 78 for raising and lowering the drill string 80. Drill string 80, as shown, extends into borehole 90 and includes a drill bit assembly 82 and steering tool 100 deployed thereon. Tool 100 includes one or more blades 150 disposed to displace the drill string 80 from the central axis of the well bore and thus change the drilling direction (as described in more detail below). Tool 100 further includes a bendable section 200 deployed in a substantially non-rotating body section of the steering tool 100. Drill string 80 may further include a downhole drilling motor, a mud pulse telemetry system, and one or more sensors, such as LWD and/or MWD tools for sensing downhole characteristics of the borehole and the surrounding formation. The invention is not limited in this regard.

It will be understood by those of ordinary skill in the art that the deployment illustrated on FIG. 1 is merely exemplary for purposes of the invention set forth herein. It will be further understood that the downhole steering tool 100 of the present invention is not limited to use with a semisubmersible platform 62 as illustrated on FIG. 1. Steering tool 100 is equally well suited for use with any kind of subterranean drilling operation, either offshore or onshore.

Figure 2:
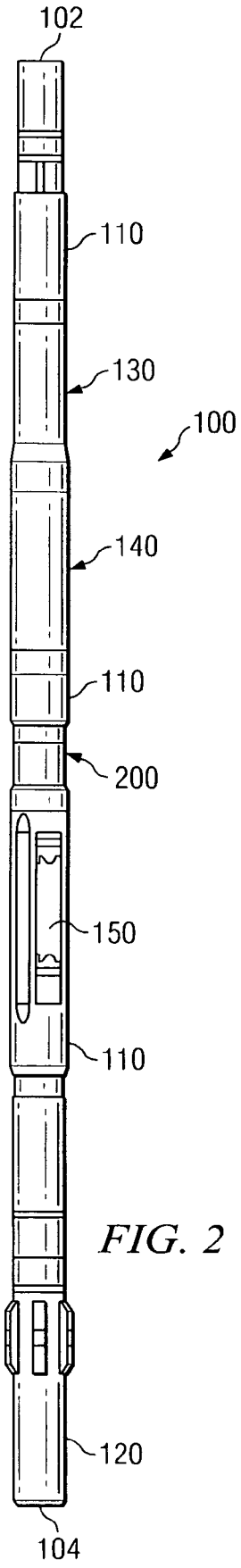
FIG. 2 is a perspective view of the steering tool shown on FIG. 1.

Turning now to FIG. 2, one exemplary embodiment of downhole steering tool 100 from FIG. 1 is illustrated in perspective view. In the exemplary embodiment shown, steering tool 100 is substantially cylindrical and includes threaded ends 102 and 104 (threads not shown) for connecting with other bottom hole assembly (BHA) components (e.g., connecting with the drill bit at end 104). The steering tool 100 further includes a tool body 110 and at least one blade 150 deployed, for example, in a recess (not shown) in the tool body 110. The tool body 110 is deployed about a rotatable shaft 115 (shown, for example, on FIG. 3). The rotatable shaft 115 is disposed to rotate substantially freely with respect to the tool body 110 and is further disposed to transfer both weight and torque to the drill bit assembly (e.g., drill bit assembly 82 shown on FIG. 1). In use, tool body 110 tends to be substantially non-rotating with respect to the borehole when the blades 150 are engaged with the borehole wall. However, it will be appreciated that in some applications (particularly when the drill bit is off bottom) the "non-rotating" tool body 110 may rotate relative to the borehole. A such, it will be appreciated that the use of the term "non-rotating" to describe the tool body 110 is intended only to convey that the tool body 110 is not rotationally coupled with the drill string. Rather as described above, it is disposed to rotate substantially freely with respect to the drive shaft 115 (and therefore with respect to the drill string).

Exemplary embodiments of steering tool 100 include three blades 150 (only one of which is shown on FIG. 2) deployed substantially equi-angularly about the tool body 110. The blades 150 are typically independently controllable via independently controllable actuation modules (not shown) and are disposed to extend radially outward from tool body 110 and to engage the borehole wall. The intent of such engagement with the borehole wall is to laterally offset the axis of the steering tool 100 from the axis of the borehole (i.e., away from the geometrical center of the borehole), which tends to alter an angle of approach of a drill bit and thereby change the drilling direction. The magnitude and direction of the offset may be directly controllable (e.g., by controlling the relative radial positions of the blades 150) or indirectly controllable (e.g., by controlling the force applied by each blade to the borehole wall). In general, increasing the magnitude of the offset (i.e., increasing the distance between the axes) tends to increase the curvature (dogleg severity) of the borehole upon subsequent drilling.

It will be appreciated that steering tools in accordance with this invention may employ substantially any suitable force application member(s), including, for example, blades, pads, and/or skids, for eccentering the tool in the borehole. Additionally substantially any suitable mechanism for extending and retracting such members may be employed. The invention is expressly not limited in these regards. Exemplary force application members and actuation mechanisms suitable for use in exemplary embodiments of this invention may be found, for example, in U.S. Pat. No. 5,603,386 to Webster, U.S. Pat. No. 6,427,783 to Krueger et al., and U.S. Pat. No. 6,761,232 to Moody et al., and to U.S. patent application Ser. No. 11/061,339 to Song et al. Such force application members are referred to herein generically as "blades" for convenience and brevity.

With continued reference to FIG. 2, tool body 110 includes a bendable section 200, which is configured to bend, pivot, and/or flex preferentially (as compared to other portions of the tool body 110) when a bending load is applied to the tool 100. In the exemplary embodiment shown, the bendable section 200 is deployed above (on the uphole side) of the blades 150, although the invention is not limited in this regard. As described in more detail below, the use of a bendable section both enables the steering tool 100 to achieve greater dogleg severity and reduces the bending stress at other locations on the tool 100. In one exemplary embodiment, as shown in more detail on FIGS. 3 and 4, a bendable section 200 in accordance with this invention includes a flexible member that flexes preferentially relative to the tool body 110 under a bending load. In another exemplary embodiment, as shown in more detail on FIGS. 5 and 6, a bendable section 300 in accordance with this invention includes a knuckle joint (universal joint) that enables upper and lower portions of the tool body to pivot relative to one another under a bending load.

The exemplary embodiment of steering tool 100 shown on FIG. 2 includes a near bit stabilizer 120 deployed below the blades 150 (on the downhole side of the tool 100), although the invention is not limited in this regard. In such a "point the bit" configuration, the direction of subsequent drilling tends to be in the opposite direction as the offset between the steering tool 100 and borehole axes. In a "push the bit" configuration (in which no near bit stabilizer is utilized), the direction of subsequent drilling tends to be the same (or nearly the same depending, for example, upon local formation characteristics) as the direction of the offset between the steering tool 100 and borehole axes.

In the exemplary embodiment shown, steering tool 100 further includes hydraulics 130 and electronics 140 modules (also referred to herein as control modules 130 and 140) deployed in the tool body 110 above the bendable section 200. In general, the control modules 130 and 140 are configured for sensing and controlling the relative positions of the blades 150 and may include substantially any devices known to those of skill in the art, such as those disclosed in U.S. Pat. No. 5,603,386 to Webster or U.S. Pat. No. 6,427,783 to Krueger et al. It will be appreciated that the invention is not limited in regard to the placement of the control modules 130 and 140 in the tool 100. Moreover, the tool 100 need not even include such modules as they may be deployed elsewhere in the drill string.

With continued reference to FIG. 2, bendable section 200 is deployed at the approximate midpoint of the steering tool body 110 between the control modules 130 and 140 and the blades 150. While the invention is not limited in regard to the location of the bendable section 200, such placement of the bendable section 200 tends to be advantageous. For example, placement of the bendable section 200 near the control modules 130 and 140 tends to reduce bending stresses in the steering tool body 110 near the control modules 130 and 140. Moreover, locating bendable section 200 near the midpoint of the tool 100 tends to increase the ability of the steering tool 100 to achieve high dogleg severity.

Figure 3:
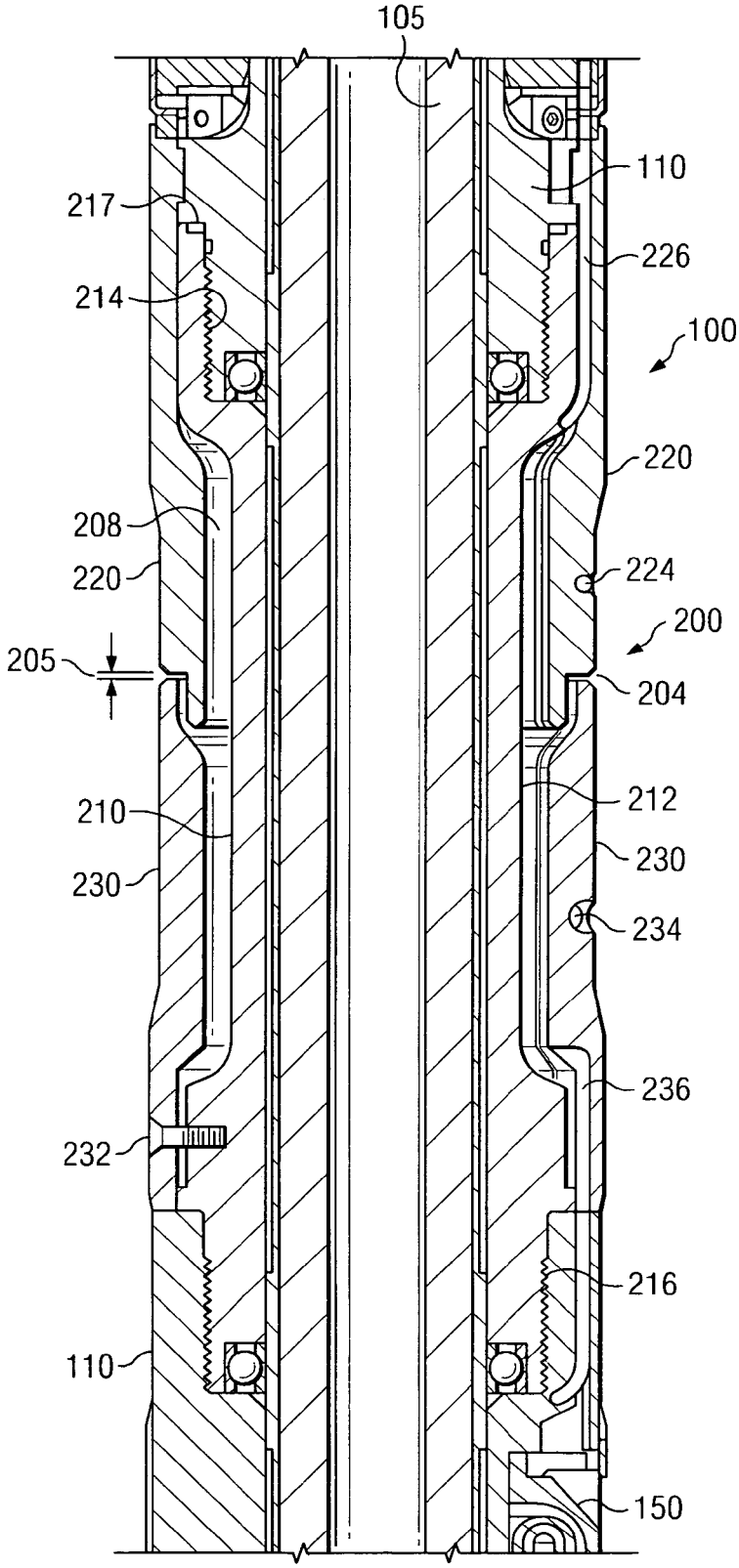
FIG. 3 depicts, in longitudinal cross section, a portion of one exemplary embodiment of the steering tool shown on FIG. 2 in which the bendable section includes a flexible member.
Figure 4:
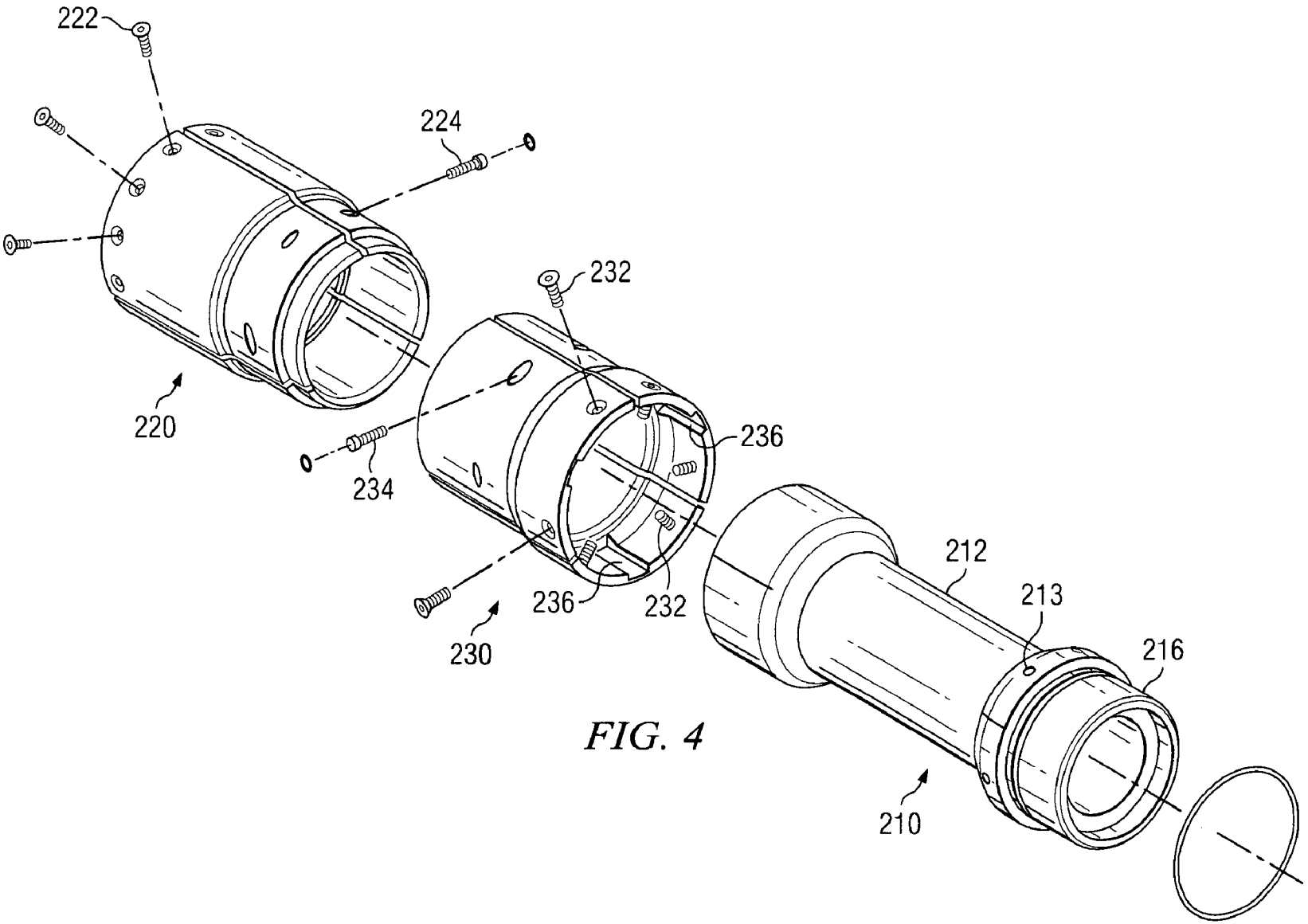
FIG. 4 is an exploded view of the bendable section 200 shown on FIG. 3.

Referring now to FIGS. 3 and 4, a portion of steering tool 100, including exemplary bendable section 200, is shown in longitudinal cross section (on FIG. 3) and in exploded view (on FIG. 4). In the exemplary embodiment shown, bendable section 200 includes a flexible body 210. Flexible body 210 is configured for connecting with the non-rotating steering tool body 110, for example, at threaded ends 214 and 216, although the invention is not limited in this regard. Flexible body 210 further includes a central flexible section 212, which is intended to be flexible relative to the steering tool body 110. In particular, it is intended that the flexible section 212 bend more under bending load than other portions of the steering tool body. Typically, such flexibility may be derived from one or more of three factors (each of the three factors are employed in the exemplary embodiment shown on FIGS. 3 and 4). First, the flexible section 212 may be fabricated from a material having a lower elastic modulus (Young's modulus) than that of the steering tool body. For example, flexible section 212 may be fabricated from aluminum, copper, or titanium alloys (the steering tool body 110 is typically fabricated from steel). In one exemplary embodiment, flexible section 212 is fabricated from a beryllium copper alloy. Second, flexible section 212 may have a thinner radial wall thickness than the steering tool body 110. And third, the flexible section 212 may have a reduced outer diameter as compared to the steering tool body 110.

Bendable section 200 further includes first 220 and second 230 protective sleeves deployed about flexible body 210. The protective sleeves 220 and 230 are typically fabricated from a material having a similar strength and elastic modulus to the steering tool body 110 (such as steel) and are intended to protect the relatively soft flexible body 210 from the aggressive borehole environment. In the exemplary embodiment shown, each of the sleeves 220 and 230 includes three substantially identical portions (each subtending an angle of about 120 degrees). A plurality of screws 224 and 234 (FIG. 4) may be utilized, for example, to connect the sleeve portions into cylindrical sleeves 220 and 230. It will be appreciated that the invention is not limited in this regard. In the exemplary embodiment shown, sleeve 230 is connected to flexible body 210 at 213 via screws 232. Sleeve 220 is connected to the steering tool 110 body via screws 222. Again, the invention is expressly not limited in these regards.

Upon assembly of the exemplary steering tool embodiment 100 shown on FIGS. 3 and 4, a circumferential gap 204 remains between the first 220 and second 230 protective sleeves (as shown on FIG. 3). The gap 204 is intended to permit flexing (bending) of the flexible section 212 under bending loads up to some predefined bending limit (which is determined by the breadth 205 of the gap 204). During bending, gap 204 narrows on one side of the tool 100 (e.g., on the left side as shown on FIG. 3) and widens on the on the other side of the tool 100 (e.g., on the right side). At the predefined maximum flex, protective sleeves 220 and 230 contact one another on one side of the tool 100, thereby increasing the rigidity of the bendable section 200 to further flexing. Such a mechanical stop essentially constrains the bendable section 200 from further bending. In this manner, the gap 204 is intended to provide an upper bending limit for the bendable section 200.

It will be appreciated that the bending limit is approximately proportional to the breadth 205 of the gap 204 (assuming a constant tool diameter). In one exemplary embodiment, the breadth 205 of the gap 204 may be about 0.06 inches, which results in an upper bend limit of about 1.5 degrees, however, the invention is not limited in this regard. It will be appreciated that sleeves 220 and 230 may be configured to provide a gap 204 having substantially any breadth 205, thereby providing substantially any bending limit. It will further be appreciated that the invention does not require a bend limiting mechanism to be employed. Nor is the use of the above-described protective sleeves 220 and 230 required.

As described above, in the exemplary embodiment of steering tool 100 shown on FIG. 2, bendable section 200 is deployed between the control modules 130 and 140 and the blades 150. Such placement of the bendable section 200 necessitates routing hydraulic and electronic communication lines from the control modules 130 and 140 through the bendable section 200 to the blades 150. In the exemplary embodiment shown on FIGS. 3 and 4, the hydraulic and electronic lines (not shown) may be routed through longitudinal grooves 226 (FIG. 3) in sleeve 220 into the annular region 208 between the sleeves 220 and 230 and the flexible body 210. The electronic and hydraulic lines may then be routed from the annular region 208 through grooves 236 in sleeve 230 to each of the blades 150. In one exemplary embodiment, a hydraulic line (tube) is utilized for each of the three blades 150. An electronic communication line (wire) is routed in the hydraulic tube (i.e., in the hydraulic fluid). In this manner, the electronic and hydraulic lines for each blade 150 are advantageously routed together and the relatively fragile electronic communications lines are protected. In order to ensure rotational alignment between the control modules 130 and 140 and the blades 150, one or more spacers 217 may be deployed between the upper end of the flexible body 210 and the steering tool body 110 as shown on FIG. 3.

Figure 5:
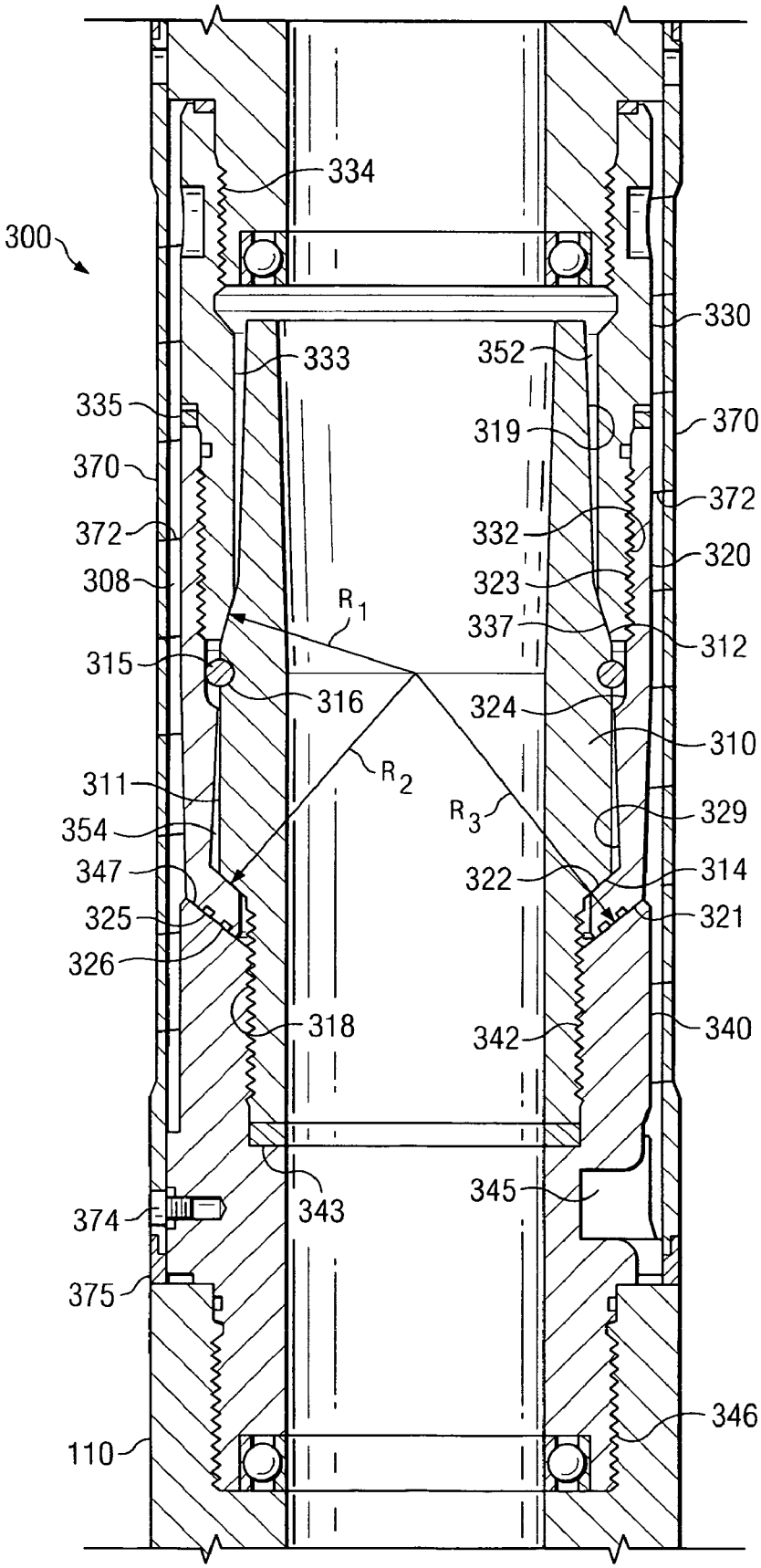
FIG. 5 depicts, in longitudinal cross section, a portion of another exemplary embodiment of a steering tool in which the bendable section includes a knuckle joint.
Figure 6:
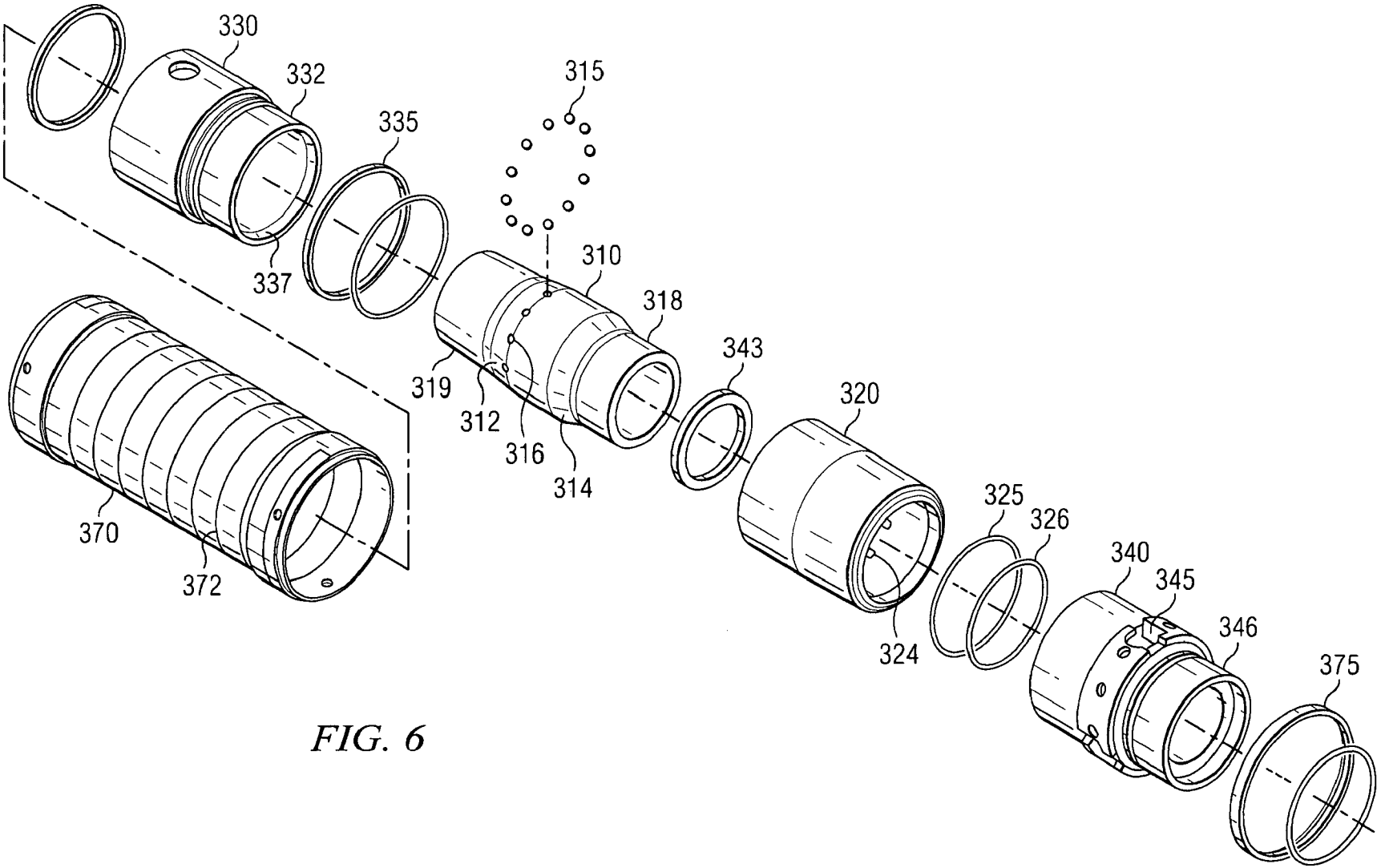
FIG. 6 is an exploded view of the bendable section 300 shown on FIG. 5.

Turning now to FIGS. 5 and 6, an alternative embodiment of a steering tool 100' according to this invention including a bendable section 300 is shown in longitudinal cross section (FIG. 5) and in exploded view (FIG. 6). Bendable section 300 includes a tubular ball member 310 having first and second outer, concave spherical surfaces 312 and 314. In the exemplary embodiment shown, ball member 310 is threadably connected at pin end 318 to box end 342 on lower end housing 340. Lower end housing 340 may be further threadably connected to a steering tool body 110 at pin end 346. Ball member 310 is deployed in and rotatably engaged with a center sleeve 320 via a plurality of bearings 315. Bearings 315 are deployed in hemispherical indentations 316 in an outer surface of the ball member 310 and engage longitudinal slots 324 on an inner surface of center sleeve 320. It will be understood that such a configuration constrains the ball member 310 and center sleeve 320 from relative rotation about the axis of the tool, while enabling the ball member 310 and center sleeve 320 to pivot relative to one another (as described in more detail below). Center sleeve 320 is further threadably connected at box end 323 to the pin end 332 of an upper end housing 330. Upper end housing 330 may be further connected to a steering tool body 110 at box end 334.

When bending loads are applied to bendable section 300, lower end housing 340 and ball member 310 are configured to pivot (knuckle) with respect to upper end housing 330 and center sleeve 320. Spherical surface 312 is pivotably engaged with inner, convex spherical surface 337 on upper end housing 330, while spherical surface 314 is pivotably engaged with inner, convex spherical surface 322 on center sleeve 320. Center sleeve 320 further includes an outer, concave spherical surface 321, which is pivotably engaged with an inner, convex spherical surface 347 on lower end housing 340. Spherical surface 321 is further sealingly engaged with spherical surface 347 via wiper 325 and pressure 326 seals. A spacer 335 is provided between the box end 323 of center sleeve 320 and a shoulder portion of upper end housing 330 to provide proper pivotal engagement between spherical surfaces 312 and 337. An additional spacer 343 is provided between ball member 310 and lower end housing 340 to provide proper pivotal engagement between spherical surfaces 314 and 322 and proper pivotal and sealing engagement between spherical surfaces 321 and 347. As described above, bearings 315 are deployed in longitudinal slots 324 in center sleeve 320. Such an arrangement allows longitudinal motion of the bearings 315 in the slots 324, thereby enabling the ball member 310 to pivot relative to the center sleeve 320.

In the exemplary embodiment shown, first and second spherical surfaces 312 and 314 on ball member 310 have corresponding first and second radii of curvature $R_1$ and $R_2$. Moreover, spherical surface 347 on lower end housing 340 has a third radius of curvature $R_3$. While the invention is not limited in this regard (to spherical surfaces having multiple radii of curvature), such an arrangement advantageously enables spherical surfaces 321 and 322 on center sleeve 320 to be captured between spherical surfaces 314 and 347. In this manner the center sleeve 320 and upper end housing 330 are axially supported relative to the ball member 310 and lower end housing 340.

With continued reference to FIGS. 5 and 6, ball member 310 further includes a tapered (angled) outer surface 319 on an upper end thereof. Such a taper results in an angled gap 352 between outer surface 319 and an inner surface 333 of the upper end housing 330 upon assembly of the bendable section 300. Center sleeve 320 further includes a tapered inner surface 329 on a lower end thereof, which results in an angled gap 342 between inner surface 329 and outer surface 311 of ball member 310. Angled gaps 342 and 352 are intended to permit bending (pivoting, knuckling) of bendable section 300 under bending loads up to some predefined bending limit. During bending, gaps 342 and 352 narrow and widen on opposite sides of the tool (e.g., gap 342 may narrow on the right side and widen on the left side while gap 352 narrows on the left side and widens on the right side of the tool). At a predefined bending limit, surface 319 contacts surface 333 and surface 311 contacts surface 329. Such a mechanical stop substantially constrains bendable section 300 from bending beyond the predefined bending limit. In this manner, the gaps 342 and 352 are intended to provide an upper bending limit for the bendable section 300.

It will be appreciated that, in the exemplary embodiment shown, the bending limit is approximately equal to the angle between surfaces 319 and 333 and surfaces 311 and 329. In one exemplary embodiment, the angle between surface 319 and 333 and surfaces 311 and 329 is approximately 2 degrees, however, the invention is not limited in this regard. Substantially any suitable angle may be employed.

With continued reference to FIGS. 5 and 6, bendable section 300 further includes a cover 370 deployed about upper end housing 330, center sleeve 320 and lower end housing 340. In the exemplary embodiment shown cover 370 is connected to lower end housing 340 via screws 374 and is further engaged with a lower end cover 375 (which is also deployed about the lower end housing 340). In the exemplary embodiment shown, cover 370 further includes a helical slot (groove) 372 formed therein, which enables the cover 370 to bend under bending load without buckling.

While not shown on FIGS. 5 and 6, exemplary embodiments of bendable section 300 may be configured to connect to steering tool 100 in the same manner as bendable section 200. For example, pin member 346 may be configured to threadably connect with a corresponding box member on a lower end of steering tool body 110, while box member 334 may be configured to threadably connect with a corresponding pin member on an upper end of steering tool body 110. As described above with respect to FIGS. 3 and 4, placement of bendable section 300 between control modules 130 and 140 and blades 150 (FIG. 2) necessitates routing hydraulic and electronic communication lines through the bendable section 300. In the exemplary embodiment shown on FIGS. 5 and 6, the hydraulic and electronic lines (not shown) may be routed from the control modules 130 and 140 through the annular region 308 between cover 370 and upper end housing 330, center sleeve 320, and lower end housing 340 to blades 150. In one exemplary embodiment, the electric line (wire) may be routed in the hydraulic line (tube), as described above with respect to FIGS. 3 and 4. Alternatively, to conserve diametrical space, for example, the hydraulic and electronic lines may be routed side by side through annular region 308 to a junction (coupling) deployed at 345. From the junction to the blade 150, the electronic lines may again be routed in the hydraulic line. The invention is not limited in this regard.

While the exemplary steering tool embodiments shown and described with respect to FIGS. 2 through 6 include only a single bendable section, it will be appreciated that the invention is expressly not limited in this regard. It will be appreciated that downhole steering tools according to the present invention may include substantially any suitable number of bendable sections. For example only, steering tool 100, shown on FIG. 2, may optionally include a second bendable section deployed, for example, between the control modules 130 and 140. Moreover, it will be appreciated that in certain embodiments, a steering tool including both a flexible section and a knuckle joint deployed therein may be advantageous.

Although the present invention and its advantages have been described in detail, it should be understood that various changes, substitutions and alternations can be made herein without departing from the spirit and scope of the invention as defined by the appended claims.

We claim:

1. A downhole steering tool comprising:

a rotatable shaft;

a substantially non-rotating steering tool body deployed about the shaft, the steering tool body including first and second longitudinally opposed ends;

a plurality of force application members deployed on the steering tool body, the force application members disposed to extend radially outward from the steering tool body and engage a borehole wall, said engagement of the force application members with the borehole wall operative to eccenter the steering tool body in the borehole; and a bendable section deployed in the steering tool body between the first and second ends, the bendable section disposed to bend preferentially relative to the steering tool body under an applied bending load.

2. The downhole steering tool of claim 1, further comprising a mechanical stop, the mechanical stop disposed to constrain the bendable section from bending beyond a predefined bending limit.

3. The downhole steering tool of claim 1, further comprising at least one control module, the bendable section deployed longitudinally between the control module and the force application members.

4. The downhole steering tool of claim 3, further comprising a plurality of control lines selected from the group consisting of electronic and hydraulic control lines routed through the bendable section from the control module to the force application members.

5. The downhole steering tool of claim 1, further comprising a near bit stabilizer deployed on a down hole end thereof.

6. The downhole steering tool of claim 1, wherein the bendable section comprises a flexible tubular member, the flexible tubular member being flexible relative to the steering tool body.

7. The downhole steering tool of claim 6, wherein the flexible tubular member is fabricated from a member of the group consisting of aluminum alloys, copper alloys, and titanium alloys.

8. The downhole steering tool of claim 6, wherein the flexible tubular member comprises at least one member of the group consisting of (i) an elastic modulus less than that of the steering tool body, (ii) a wall thickness less than that of the steering tool body; and (iii) an outer diameter less than that of the steering tool body.

9. The downhole steering tool of claim 6, further comprising first and second sleeves deployed about the flexible tubular member, the sleeves disposed to permit flexing of the flexible tubular member up to a predefined bending limit, the sleeves further disposed to substantially prevent flexing of the flexible tubular member beyond the predefined bending limit.

10. The downhole steering tool of claim 9, wherein the predefined bending limit is substantially proportional to a breadth of a circumferential gap between the first and second sleeves.

11. The downhole steering tool of claim 1, wherein the bendable section comprises a knuckle joint, upper and lower portions of the steering tool body disposed to pivot about the knuckle joint under an applied bending load.

12. The downhole steering tool of claim 11, wherein the bendable section comprises a tubular ball member deployed in at least one outer member, the tubular ball member including first and second spherical surfaces pivotably engaged with corresponding first and second spherical surfaces on the at least one outer member.

13. The downhole steering tool of claim 12, wherein the first and second spherical surfaces have corresponding first and second radii of curvature, the second radius of curvature being greater than the first radius of curvature.

14. The downhole steering tool of claim 13, wherein said engagement of the second spherical surface on the tubular ball member with the second spherical surface on the at least one outer member substantially constrains relative axial motion between the tubular ball member and the at least one outer member.

15. The downhole steering tool of claim 12, wherein the tubular ball member is rotationally engaged with the at least one outer member via a plurality of bearings deployed in (i) indentations in an outer surface of the tubular ball member and (ii) corresponding longitudinal slots in an inner surface of the at least one outer member.

16. The downhole steering tool of claim 12, wherein the tubular ball member and the at least one outer member are disposed to pivot relative to one another up to a predefined angular limit, the tubular ball member and the at least one outer member constrained from pivoting relative to one another beyond the predefined angular limit.

17. The downhole steering tool of claim 1, wherein the rotatable shall is disposed to transfer both weight and torque to a drill bit.

18. A downhole steering tool comprising:

a rotatable shaft;

a substantially non-rotating steering tool body deployed about the shaft, the steering tool body including first and second longitudinally opposed ends;

a plurality of force application members deployed on the steering tool body, the force application members disposed to extend radially outward from the steering tool body and engage a borehole wall, said engagement of the force application members with the borehole wall operative to eccenter the steering tool body in the borehole; and a flexible tubular member deployed in the steering tool body between the first and second ends, the flexible tubular member disposed to flex preferentially relative to the steering tool body under an applied bending load.

19. The downhole steering tool of claim 18, wherein the flexible tubular member is fabricated from a member of the group consisting of aluminum alloys, copper alloys, and titanium alloys.

20. The downhole steering tool of claim 18, wherein the flexible tubular member comprises at least one member of the group consisting of (i) an elastic modulus less than that of the steering tool body, (ii) a wall thickness less than that of the steering tool body; and (iii) an outer diameter less than that of the steering tool body.

21. The downhole steering tool of claim 18, further comprising first and second sleeves deployed about the flexible tubular member, the sleeves disposed to permit flexing of the flexible tubular member up to a predefined bending limit, the sleeves further disposed to substantially prevent flexing of the flexible tubular member beyond the predefined bending limit.

22. The downhole steering tool of claim 21, wherein the predefined bending limit is substantially proportional to a breadth of a circumferential gap between the sleeves and the flexible tubular member.

23. The downhole steering tool of claim 22, wherein the first and second sleeves contact one another when the steering tool is flexed to the predefined bending limit.

24. The downhole steering tool of claim 21, further comprising a plurality of control lines routed through an annular region between the sleeves and the flexible tubular member.

25. The downhole steering tool of claim 24, wherein the control lines are further routed through corresponding longitudinal slots formed on inner surfaces of the sleeves.

26. A downhole steering tool comprising:

a rotatable shaft;

a substantially non-rotating steering tool body deployed about the shaft, a plurality of force application members deployed on the steering tool body, the force application members disposed to extend radially outward from the steering tool body and engage a borehole wall, said engagement of the force application members with the borehole wall operative to eccenter the steering tool body in the borehole; and a knuckle joint deployed in the steering tool body, upper and lower portions of the steering tool body disposed to pivot about the knuckle joint under an applied bending load.

27. The downhole steering tool of claim 26, wherein the knuckle joint comprises a tubular ball member deployed in at least one outer member, the tubular ball member including first and second spherical surfaces pivotably engaged with corresponding first and second spherical surfaces on the at least one outer member.

28. The downhole steering tool of claim 27, wherein the first and second spherical surfaces have corresponding first and second radii of curvature, the second radius of curvature being greater than the first radius of curvature.

29. The downhole steering tool of claim 28, wherein said engagement of the second spherical surface on the tubular ball member with the second spherical surface on the outer member substantially constrains relative axial motion between the tubular ball member and the at least one outer member.

30. The downhole steering tool of claim 27, wherein the tubular ball member is rotationally engaged with the at least one outer member via a plurality of bearings deployed in (i) indentations in an outer surface of the tubular ball member and (ii) corresponding longitudinal slots in an inner surface of the at least one outer member.

31. The downhole steering tool of claim 27, wherein the tubular ball member and the at least one outer member are disposed to pivot relative to one another up to a predefined angular limit, the tubular ball member and the at least one outer member substantially restrained from pivoting relative to one another beyond the predefined angular limit.

32. The downhole steering tool of claim 31, further comprising at least one tapered gap between the tubular ball member and the at least one outer member, the predefined angular limit substantially equal to a tapered gap angle.

33. The downhole steering tool of claim 27, further comprising a cover deployed about the at least one outer member, the cover including a helical slot formed therein.

34. The downhole steering tool of claim 33, further comprising a plurality of control lines routed through an annular region between the cover and the at least one outer member.

35. A downhole steering tool comprising:

a rotatable shaft;

a substantially non-rotating steering tool body deployed about the shaft;

a plurality of force application members deployed on the steering tool body, the force application members disposed to extend radially outward from the steering tool body and engage a borehole wall, said engagement of the force application members with the borehole wall operative to eccenter the steering tool body in the borehole;

a flexible tubular member deployed in the steering tool body, the flexible tubular member disposed to flex preferentially relative to the steering tool body under an applied bending load; and first and second sleeves deployed about the flexible tubular member, the sleeves disposed to permit flexing of the flexible tubular member up to a predefined bending limit, the sleeves further disposed to substantially prevent flexing of the flexible tubular member beyond the predefined bending limit.

36. A downhole steering tool comprising:

a rotatable shaft;

a substantially non-rotating steering tool body deployed about the shaft;

a plurality of force application members deployed on the steering tool body, the force application members disposed to extend radially outward from the steering tool body and engage a borehole wall, said engagement of the force application members with the borehole wall operative to eccenter the steering tool body in the borehole;

a knuckle joint deployed in the steering tool body, upper and lower portions of the steering tool body disposed to pivot about the knuckle joint under an applied bending load;

the knuckle joint including a tubular ball member deployed in at least one outer member, the tubular ball member including first and second spherical surfaces pivotably engaged with corresponding first and second spherical surfaces on the at least one outer member, the first and second spherical surfaces having corresponding first and second radii of curvature, the second radius of curvature being greater than the first radius of curvature; and a mechanical stop disposed to constrain the tubular ball member and the at least one outer member from pivoting relative to one another beyond a predefined angular limit.

* * * * *